181-198 SR
12/27/83 XR 4,423,293

United States Patent [19]
Murayama et al.

[11] 4,423,293
[45] Dec. 27, 1983

[54] MICROPHONE HOLDING DEVICE

[75] Inventors: Masato Murayama, Kawagoe; Tetsuyuki Manaka, Otonemachi, both of Japan

[73] Assignee: Clarion Co., Ltd., Tokyo, Japan

[21] Appl. No.: 273,136

[22] Filed: Jun. 12, 1981

[30] Foreign Application Priority Data

Jun. 16, 1980 [JP] Japan ..... 55-84066[U]

[51] Int. Cl.[3] ..... H04R 1/28
[52] U.S. Cl. ..... 179/156 R; 179/156 A; 179/179; 179/187; 181/21; 181/198
[58] Field of Search ..... 179/156 R, 179, 1 FS, 179/180, 156 A, 187, 121 R; 181/21, 158, 198, 242

[56] References Cited

U.S. PATENT DOCUMENTS

| | | | |
|---|---|---|---|
| 2,518,805 | 8/1950 | Massa | 181/148 |
| 4,263,484 | 4/1981 | Hisatsune et al. | 179/111 E |

FOREIGN PATENT DOCUMENTS

| | | | |
|---|---|---|---|
| 2245881 | 3/1974 | Fed. Rep. of Germany | 179/156 R |
| 2368236 | 6/1978 | France | 179/156 R |
| 2063619 | 6/1981 | United Kingdom | 179/156 R |

*Primary Examiner*—G. Z. Rubinson
*Assistant Examiner*—Danita R. Byrd
*Attorney, Agent, or Firm*—Flynn, Thiel, Boutell & Tanis

[57] ABSTRACT

A microphone holding device which holds a microphone in a casing so that the microphone is disposed substantially perpendicularly to the surface of a concave of a helmet, etc. for receiving the microphone in it. Thus, both the sound collecting portion and the opposed end of the microphone are kept freely communicated with the outside of the casing.

8 Claims, 3 Drawing Figures

MICROPHONE HOLDING DEVICE

BACKGROUND OF THE INVENTION

1. Field of the Invention

This invention relates to a microphone holding device and more specifically to improvements in a microphone holding device of a type which is mounted on a helment, etc. in a manner being buried therein.

2. Description of the Prior Art

Conventionally there has been provided a communicating device for drivers of motorcycles, etc. a microphone and a headphone of which are buried inside the helmet. However, such conventional device has a drawback of causing howling in accordance with increase of volume of the headphone.

It is considered that such a drawback of the conventional device is caused by the following reasons. That is, the microphone of the device is mounted in a manner that the rear end thereof (the end opposite to the sound collecting portion at the front end thereof) is entirely adhered to the inner surface of the helmet. Therefore, only loading (sound pressure) from the front end of the microphone is applied to the vibrating reed (i.e., diaphragm or other vibrating element constituting the sound collecting portion) of the microphone, thereby causing peaks in its frequency response characteristic, and thus, the vibrating reed is made to vibrate very easily in a specific frequency corresponding to such peak.

SUMMARY OF THE INVENTION

It is therefore an object of the present invention to eliminate the above drawback of the prior art. In accordance with the present invention, there is provided a microphone holding device which comprises:

a microphone; and a microphone holder for holding said microphone approximately perpendicular to the surface of a mounting portion of a body in which said microphone is mounted, thus to keep both the sound collecting portion, and the end of said microphone opposite to said sound collecting portion, freely communicated with the outside of the microphone holder.

BRIEF DESCRIPTION OF THE DRAWINGS

FIGS. 1, 2 and 3 show an embodiment of the microphone holding device according to the present invention, in which FIG. 1 is a central cross-sectional view of the device substantially along the line I—I of FIG. 2, FIG. 2 is a side view of the device (omitting the lead 5), and FIG. 3 is a reduced scale central cross-sectional view of the device installed in a helmet.

DETAILED DESCRIPTION OF THE PREFERRED EMBODIMENTS

The present invention will now be described in detail referring to the preferred embodiment.

Figure 1:
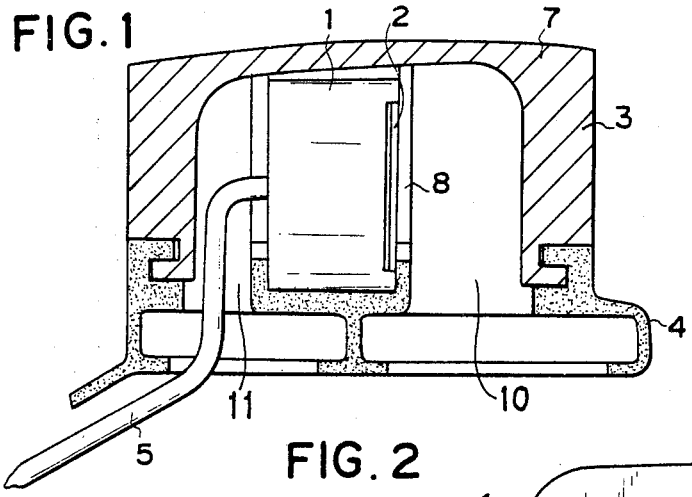
Figure 2:
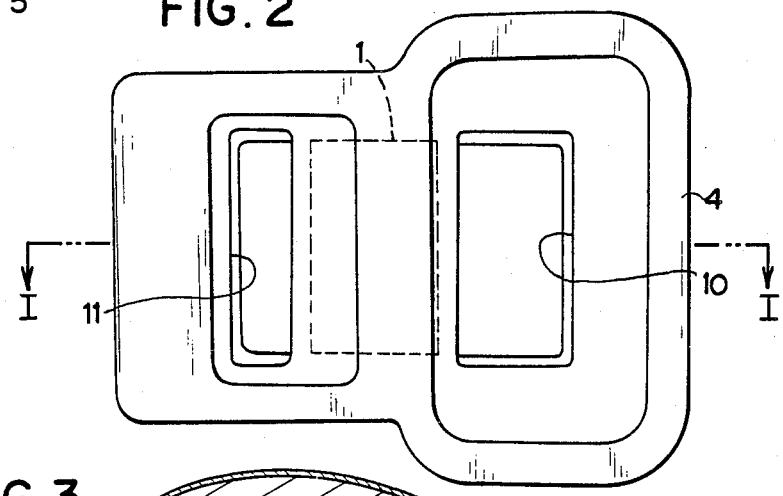
Figure 3:
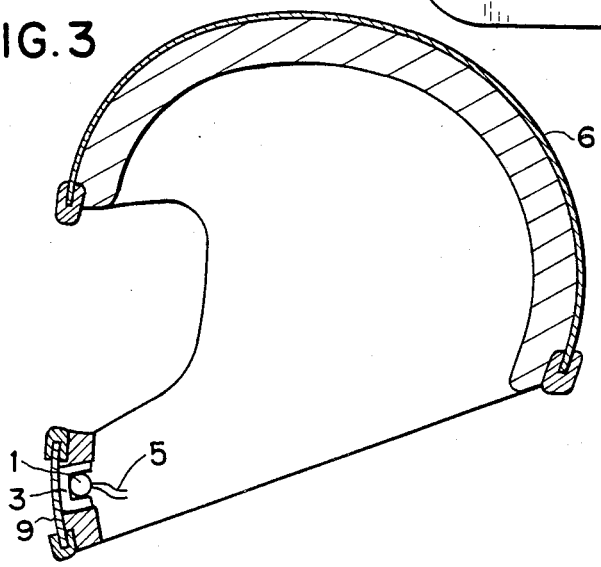
Figure 1:
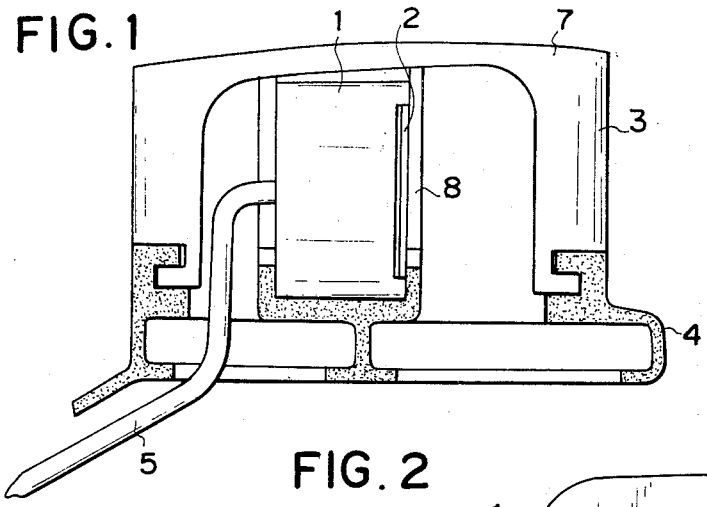
Figure 2:
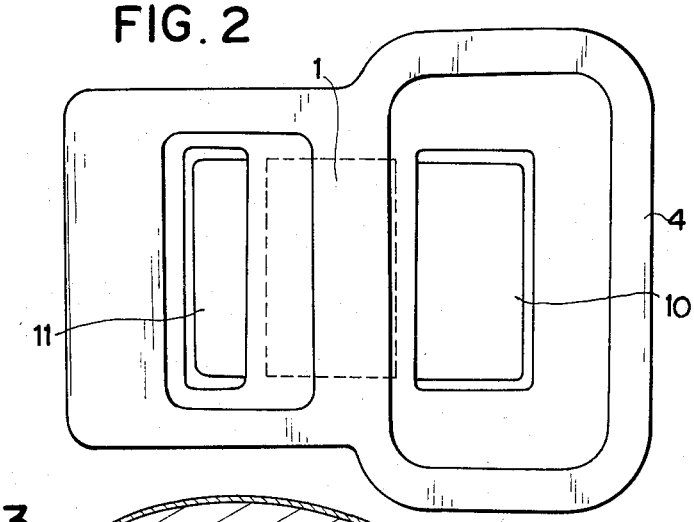
Figure 3:
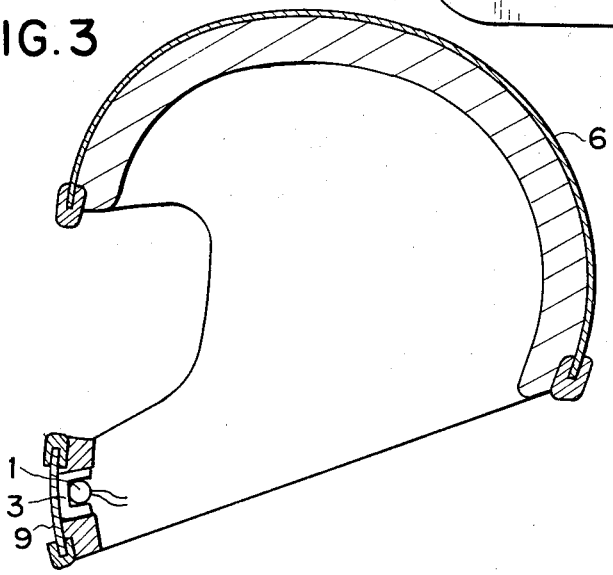

In the drawings of FIG. 1—FIG. 3, the reference numeral 1 designates a microphone, 2 a sound collecting portion (for example a vibrating reed or the like) of said microphone 1, 3 a casing for holding the microphone, 4 a sound collecting duct, 5 a lead, which caries the electrical output from the microphone 1, and 6 a helmet, respectively.

The casing 3 has a bottom 7 of an arc configuration corresponding to an inner surface of the helmet 6 so as to be buried in an inner wall of the helmet 6. The casing 3 is formed with a microphone holding portion 8 therewithin, in which the microphone 1 is inserted to be supported in a manner being disposed approximately perpendicularly to the bottom 7 of the casing 3, and accordingly against the bottom wall 9 of a concave formed inside the helmet 6 for coupling the casing 3 therein.

Therefore, the microphone is supported so as to keep both its sound collecting portion 2 and its opposite end in free communication with the outside of the casing 3 (with the inside of the helmet), so that loading (sound pressure) from both the front and rear ends of the microphone 1 is applied to the vibrating reed 2 and thus peaks in its vibrating frequency response characteristic are not caused, whereby even when the headphone (not shown) is disposed in a portion extremely near to the microphone 1, howling can be avoided.

In this case, the sound collecting duct 4 is made of an elastic material such as rubber, etc. and is mounted in the opening portion of the casing 3 as shown in the drawings. Therefore, its sound collecting efficiency is further improved to thereby enable obtaining a predetermined sound pressure. Additionally, an opening 10 of the sound collecting duct 4 adjacent to the sound collecting portion 2 of the microphone 1 is formed larger than an opening 11 adjacent to the opposite, rear end of the microphone 1. The latter construction is effective in reducing mutual cancellation of components of sound pressure applied simultaneously to the front and rear faces of the vibrating reed 2 by means of sound between waves of the same phase coming into the openings 10 and 11, and accordingly in increasing the sound pressure difference at the front and rear ends of the microphone (and hence the output of the microphone).

As described above, according to the invention, howling caused in the prior art can be eliminated even if a microphone and a headphone are positioned near each other. Further, very good results can be obtained particularly on mounting such a device inside a helmet.

Incidentally, the invention keeps its effectiveness even when applied in an interphone capable of simultaneously speaking, for example, without being restricted to a helmet.

We claim:

1. A microphone holding device which comprises:

a microphone having a sound collecting portion at one end and another end opposite said sound collecting portion; and a microphone holder for holding said sound collecting portion of said microphone substantially perpendicular to the surface of the adjacent wall of a body in which said microphone is mounted, said microphone holder comprising a casing containing the microphone and having a box-like configuration having an open side with at least 2 openings, said 2 openings communicating with said sound collecting portion and said other end of said microphone, respectively, thus to keep both said sound collecting portion and said other end of said microphone in free communication with the outside of the microphone holder.

2. The microphone holding device as claimed in claim 1, wherein said body is a helmet for a driver of a motorcycle.

3. The microphone holding device as claimed in claim 2, wherein said casing has a bottom of an arc configuration corresponding to an inner wall surface of said helmet.

4. The microphone holding device as claimed in claim 3, wherein said holder further comprises a sound collecting duct fixed to said casing and having openings communicating with said openings of said casing to effect said free communication of said ends of said microphone individually with the outside of said holder.

5. The microphone holding device as claimed in claim 5, wherein said at least two openings of said casing differ in size, as do the corresponding said openings in said sound collecting duct, for reducing mutual cancellation of sound applied to opposite ends of said microphone.

6. The microphone holding device as claimed in claim 3, wherein said holder further comprises a sound collecting duct fixed to said casing and having openings communicating with said openings of said casing to effect said free communication of said ends of said microphone individually with the outside of said holder, and wherein said at least two openings of said casing differ in size, as do the corresponding said openings in said sound collecting duct, for reducing mutual cancellation of sound applied to opposite ends of said microphone.

7. The microphone holding device as claimed in claim 6, in which said openings in said sound collecting duct are located side by side and face into the interior of the helmet for communicating both ends of said microphone with the interior of said helmet, said sound collecting portion of said microphone facing in a direction substantially parallel to the adjacent interior wall surface of the helmet, said openings in said holder forming a generally U-shaped open ended passage with said microphone at the bight of said U-shaped passage, the ends of said microphone being aligned on an axis transverse to the length extent of said side-by-side openings in said holder.

8. The microphone holding device as claimed in claim 4, wherein said sound collecting duct is of a rubberlike elastic material and separates the open side of the casing, and the microphone therein, from the interior of said helmet.

* * * * *

UNITED STATES PATENT AND TRADEMARK OFFICE

CERTIFICATE OF CORRECTION

PATENT NO. : 4 423 293

DATED : December 27, 1983

INVENTOR(S) : Masato MURAYAMA et al

It is certified that error appears in the above-identified patent and that said Letters Patent is hereby corrected as shown below:

Claim 5, line 2; change "Claim 5" to ---Claim 4---.

In the drawings; delete Sheet 2 of 2.

Signed and Sealed this

*Tenth* Day of *July 1984*

[SEAL]

*Attest:*

GERALD J. MOSSINGHOFF

*Attesting Officer*

*Commissioner of Patents and Trademarks*